US011448987B2

(12) United States Patent
Nihonyanagi et al.

(10) Patent No.: US 11,448,987 B2
(45) Date of Patent: Sep. 20, 2022

(54) IMAGE FORMING APPARATUS

(71) Applicant: Canon Kabushiki Kaisha, Tokyo (JP)

(72) Inventors: Koji Nihonyanagi, Shizuoka (JP); Masato Sako, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/218,432

(22) Filed: Mar. 31, 2021

(65) Prior Publication Data

US 2021/0302880 A1 Sep. 30, 2021

(30) Foreign Application Priority Data

Mar. 31, 2020 (JP) ..... JP2020-062729

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 5,724,628 A * 3/1998 Sano ..... G03G 15/2064 219/216
10,488,792 B2 11/2019 Sako et al.
10,691,048 B2 6/2020 Mochizuki
10,969,712 B2 4/2021 Sako et al.
2018/0004134 A1* 1/2018 Nomura ..... G03G 15/2017
2019/0129335 A1* 5/2019 Cao ..... G03G 15/205
2020/0333732 A1 10/2020 Uchiyama et al.

FOREIGN PATENT DOCUMENTS

JP 0695540 A 4/1994
JP 2006039027 A 2/2006
JP 2012053482 A 3/2012
JP 2015125165 A 7/2015
JP 2018072374 A 5/2018
JP 2019128551 A 8/2019

* cited by examiner

*Primary Examiner* — Clayton E. LaBalle
*Assistant Examiner* — Michael A Harrison
(74) *Attorney, Agent, or Firm* — Venable LLP

(57) ABSTRACT

In an image forming apparatus, in continuous image formation in which images are continuously formed and fixed on a plurality of recording materials in a fixing portion, with a period from start of the continuous image formation on a first recording material to arrival thereof at the fixing unit being regarded as a first period, and with a period from the arrival of the first recording material at the fixing portion to the end of the continuous image formation being regarded as a second period, a second maximum energizing duty that is set when the control portion supplies power to a plurality of heating elements in the second period is higher than a first maximum energizing duty that is set when the control portion supplies power to the plurality of heating elements in the first period.

11 Claims, 11 Drawing Sheets

IMAGE FORMING APPARATUS

BACKGROUND OF THE INVENTION

Field of the Invention

The present invention relates to an image forming apparatus, such as a copier and printer which uses an electrophotographic system or the like, and which includes an image heating apparatus and forms an image on a recording material.

Description of the Related Art

In recent years, as a fixing apparatus included in an image forming apparatus, such as a laser printer using an electrophotographic system, a fixing apparatus, based on a system that selectively heats an image portion formed on a recording material, has been proposed to meet power saving demands (Japanese Patent Application Publication No. H06-95540). With regard to heating elements based on this system, a plurality of divided heating regions are set in a direction perpendicular to a conveying direction of a recording material (hereafter "longitudinal direction"), and a plurality of heating elements which heat the heating regions respectively are disposed in the longitudinal direction. Then based on image information on an image that is formed in each heating region, the image portion is selectively heated by the heating element corresponding thereto. Further, in a case where the heating temperature of a region where a toner image is not formed on the recording material (hereafter "non-image portion") is controlled at a temperature lower than the heating temperature of the image portion, a method of preventing image problems, e.g. fixing failure, by changing the temperature rising timing of a fixing member in accordance with the thermal history of each heating region has been proposed (Japanese Patent Application Publication No. 2015-125165).

On the other hand, as the speed of the image forming apparatus increases, a motor used for the image forming apparatus becomes faster/larger, which increases the current consumption of the image forming apparatus. Further, colors are more commonly used for office documents and more color laser printers are being manufactured. A color laser printer forms a plurality of images simultaneously, therefore more motors are used therein and current consumed by the fixing apparatus is also high in order to fix a plurality of toner images on the recording material. As a result, current consumption of the image forming apparatus is constantly on the rise. One guideline of the upper limit of current consumed by such apparatuses is a maximum current, which is a rated current that a commercial power supply can provide (e.g. 15 A=1500 W/100 V), therefore the image forming apparatus has to be designed so that the current consumption thereof does not exceed the rated current of the commercial power supply. This means that in a conventional image forming apparatus, a current detection device to detect current flowing into the image forming apparatus is disposed to limit the current flowing into the fixing apparatus, so as not to exceed the rated current of the commercial power supply (Japanese Patent Application Publication No. 2006-39027).

SUMMARY OF THE INVENTION

However, in the methods disclosed in Japanese Patent Application Publication No. H06-95540 and No. 2015-125165, nothing is mentioned about detecting current that flows into each of a plurality of divided heating elements in each heating region, and controlling the current so as not to exceed the maximum current value which the commercial power supply can supply. In particular, in a case of performing control for energy saving by differentiating the heating temperature of an image portion from the heating temperature of a non-image portion, current has to be limited more than necessary if the limited current value is set equally for all of the plurality of heating elements so as not to exceed the limit value of the commercial power supply. This may in some cases require approaches such as decreasing print speed.

In Japanese Patent Application Publication No. 2006-39027, a control to limit the current supplied to the fixing apparatus is performed, but how to limit the current for the plurality of heating elements is not mentioned. Further, if the limited current value is set equally for all of the plurality of heating elements, the current in some cases has to be limited more than necessary. This may in some cases require approaches such as decreasing print speed.

In an image forming apparatus in which current that is supplied to a fixing apparatus, is limited so as not to exceed the capacity of commercial power supply, it is an object of the present invention to provide a technique to minimize a drop in print speed while preventing current from being limited more than necessary.

To achieve the above object, an image forming apparatus of the present invention includes:

an image forming portion configured to form an image on a recording material;

a fixing portion configured to heat the image and fix the image on the recording material, and including a plurality of heating elements arranged in a direction perpendicular to a conveying direction of the recording material;

a plurality of temperature detecting portions configured to individually detect temperatures of a plurality of heating regions which are heated by the plurality of heating elements respectively;

a control portion configured to individually control an energizing duty according to power supplied to a plurality of heating elements so that each of the temperatures detected by the plurality of temperature detecting portions maintain control target temperatures, the control portion setting a control target temperature of an image heating region, which is a region to heat an image portion where the image is formed in the recording material, out of the plurality of heating regions, as a first control target temperature and a control target temperature of a non-image heating region, which is a region to heat a non-image portion where the image is not formed in the recording material, out of the plurality of heating regions, as a second control target temperature, which is lower than the first control target temperature; and a current detecting portion configured to detect current that flows to the plurality of heating elements, wherein the control portion sets the energizing duty within a range of a maximum energizing duty, in continuous image formation in which the images are continuously formed and fixed on a plurality of recording materials from an initial state where the temperature detected by the temperature detecting portion becomes not higher than a predetermined temperature, when a period from start of the continuous image formation on a first recording material, out of the plurality of recording materials, to arrival of the first recording material at the fixing portion, is regarded as a first period, and a period from the arrival of the first recording material at the fixing portion to the end of the continuous image formation is regarded as a second period, a second maximum energizing duty that is set when the control portion supplies power to the plurality of heating elements in the second period is higher than a first maximum energizing duty that is set when the control portion supplies power to the plurality of heating elements in the first period, and the second maximum energizing duty switched from the first maximum energizing duty in the middle of the second period.

To achieve the above object, an image forming apparatus of the present invention includes:

an image forming portion configured to form an image on a recording material;

a fixing portion configured to heat the image and fix the image on the recording material, and including a plurality of heating elements arranged in a direction perpendicular to a conveying direction of the recording material;

a plurality of temperature detecting portions configured to individually detect temperatures of a plurality of heating regions which are heated by the plurality of heating elements respectively;

a control portion configured to individually control an energizing duty according to power supplied to the plurality of heating elements so that each of the temperatures detected by the plurality of temperature detecting portions maintain control target temperatures, the control portion setting a control target temperature of an image heating region, which is a region to heat an image portion where the image is formed in the recording material, out of a plurality of heating regions, as a first control target temperature and a control target temperature of a non-image heating region, which is a region to heat a non-image portion where the image is not formed in the recording material, out of the plurality of heating regions, as a second control target temperature, which is lower than the first control target temperature; and a voltage detecting portion configured to detect input voltage that is inputted to the image forming portion and the fixing portion, wherein the control portion sets the energizing duty within a range of a maximum energizing duty, in a continuous image formation in which the images are continuously formed and fixed on a plurality of recording materials from an initial state where the temperature detected by the temperature detecting portion becomes not higher than a predetermined temperature, when a period from start of the continuous image formation on a first recording material, out of the plurality of recording materials, to arrival of the first recording material at the fixing portion, is regarded as a first period, and a period from the arrival of the first recording material at the fixing portion to the end of the continuous image formation is regarded as a second period, a second maximum energizing duty that is set when the control portion supplies power to the plurality of heating elements in the second period is higher than a first maximum energizing duty that is set when the control portion supplies power to the plurality of heating elements in the first period, and the second maximum energizing duty switched from the first maximum energizing duty in the middle of the second period.

According to the present invention, in an image forming apparatus in which current that is supplied to the fixing apparatus is limited so as not to exceed the capacity of the commercial power supply, a drop in print speed can be minimized while preventing current from being limited unnecessarily.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Configuration of Image Forming Apparatus

Figure 1:
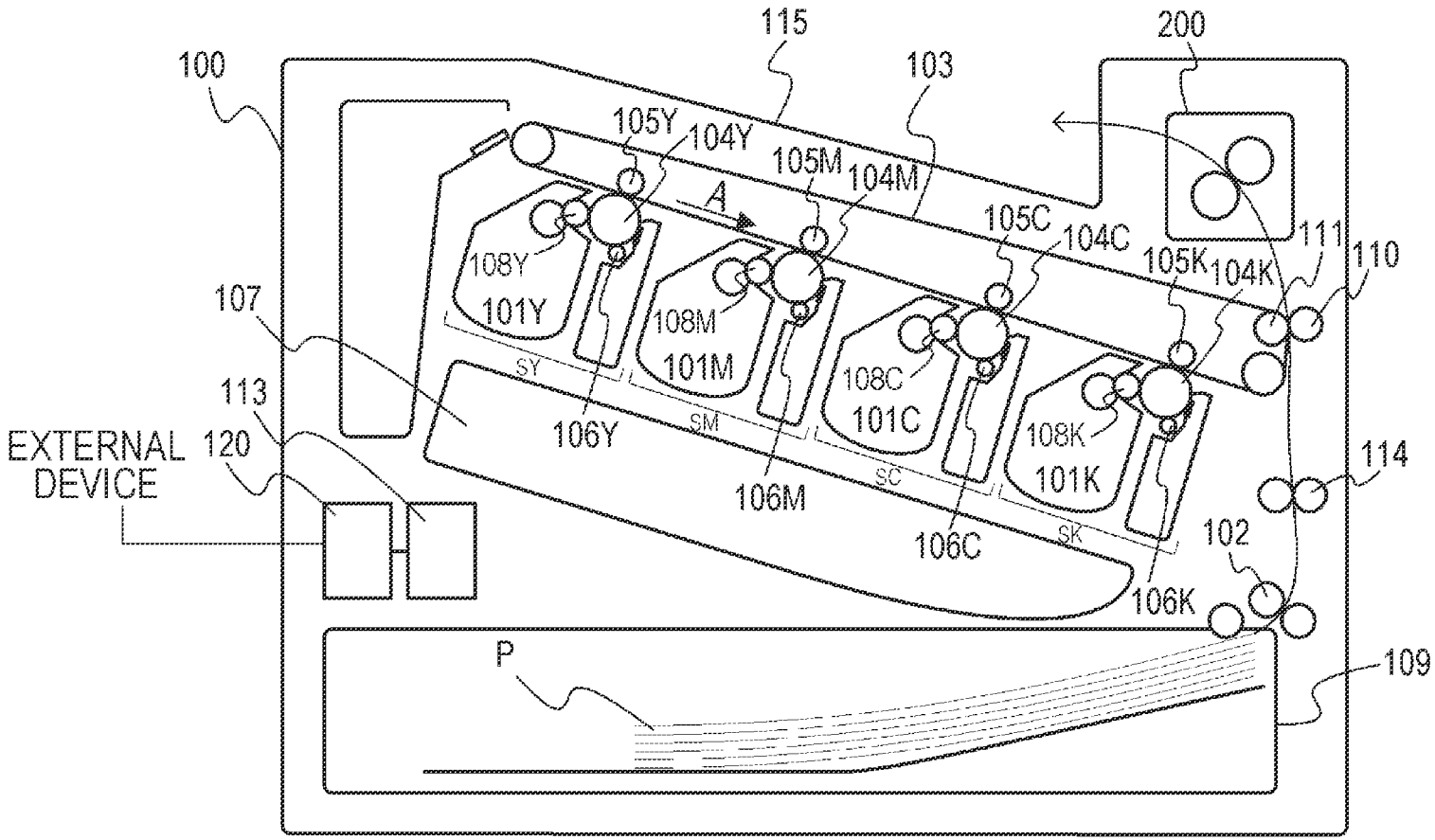
FIG. 1 is a schematic cross-sectional view of an image forming apparatus of an embodiment of the present invention.

FIG. 1 is an exemplary configuration of an electrophotographic type image forming apparatus according to Embodiment 1. Image forming apparatuses to which the present invention can be applied are printers and copiers using an electrophotographic system or electrostatic recording system, for example, and a case of applying the present invention to a laser printer will be described here.

A video controller 120 receives and processes image information and print instructions which are sent from an external device (e.g. host computer). A control portion 113 is connected to the video controller 120, and controls each component constituting the image forming apparatus in accordance with instructions from the video controller 120.

The image forming apparatus 100 includes image forming stations SY, SM, SC and SK for respective colors. For example, the image forming station SY for yellow is constituted of a process cartridge 101Y, an intermediate transfer belt 103 which rotates in the arrow A direction indicated in FIG. 1, and primary transfer roller 105Y which is disposed on an opposite side of the process cartridge 101Y via the intermediate transfer belt 103. Each image forming station SY, SM, SC and SK is disposed side by side in the rotating direction of the intermediate transfer belt 103, and is substantially identical except that the color of the image to be formed is different. Therefore, unless a distinction is especially required, each image forming station is described in general terms, omitting suffix Y, M, C or K to indicate the color for which the element is disposed.

The process cartridge 101 includes a photosensitive drum 104, which is an image bearing member. The photosensitive drum 104 is rotary-driven clockwise by a driving unit (not illustrated). A charging roller 106 uniformly charges the surface of the photosensitive drum 104 when high voltage is applied by a high voltage power supply (not illustrated). Then based on the image information inputted to the video controller 120, a scanner unit 107, which is an exposing unit, emits laser beams to the photosensitive drum 104 and forms an electrostatic latent image on the surface of the photosensitive drum 104. A developing roller 108, which is a developer supply unit, is rotated counterclockwise by a driving unit (not illustrated), so that toner (developer), which is coated and charged on the surface of the developing roller 108, adheres to the electrostatic latent image on the surface of the photosensitive drum 104, whereby the electrostatic latent image becomes a visible image. Hereafter, the visible image formed by the toner is referred to as a "toner image". A base layer of the photosensitive drum 104 is grounded, and voltage of which polarity is opposite of toner is applied to a primary transfer roller 105 by a high voltage power supply (not illustrated). Therefore a transfer electric field is formed at a nip between the primary transfer roller 105 and the photosensitive drum 104, and the toner image is transferred from the photosensitive drum 104 to the intermediate transfer belt 103.

As illustrated in FIG. 1, as the intermediate transfer belt 103 rotates in the arrow A direction, each toner image generated by the image station S of each color is formed on the intermediate transfer belt 103, and is conveyed.

In a paper feeding cassette 109, recording materials P are stacked and stored. When the video controller 120 receives a print instruction from the external device, the image forming apparatus 100 feeds the recording material P using a feed roller 102, and conveys the recording material P toward the intermediate transfer belt 103. The recording material P is conveyed to a contact nip portion of a secondary transfer roller 110 and a secondary transfer counter roller 111 at a predetermined timing via a resist roller pair 114. Specifically, the recording material P is conveyed at a timing so that the tip portion of the toner image of the intermediate transfer belt 103 and the tip portion of the recording material P overlap. While the recording material P is conveyed in a state of being held between the secondary transfer roller 110 and the secondary transfer counter roller 111, voltage of which polarity is opposite of toner is applied to the secondary transfer roller 110 by a power supply device (not illustrated). Since the secondary transfer counter roller 111 is grounded, a transfer electric field is formed between the secondary transfer roller 110 and the secondary transfer counter roller 111. By this transfer electric field, the toner image is transferred from the intermediate transfer belt 103 to the recording material P. After passing through the nip between the secondary transfer roller 110 and the secondary transfer counter roller 111, the recording material P is heated and pressed by a fixing apparatus (image heating apparatus) 200, which is a fixing portion (image heating portion). Thereby the toner image on the recording material P is fixed to the recording material P. Then the recording material P is conveyed to a paper delivery tray 115, and the image forming process completes.

The control portion 113 includes a storage portion that stores a temperature control program of the fixing apparatus 200. In the above configuration, the portion of the configuration, which is related to the process up to the step of forming the unfixed toner image on the recording material, corresponds to the image forming portion according to the present invention.

In this embodiment, an image forming apparatus, of which maximum paper passing width in a direction perpendicular to the conveying direction of the recording material P is 216 mm, and which can print a recording material of letter size (216 mm×279 mm), is used.

Configuration of Fixing Apparatus

Figure 2:
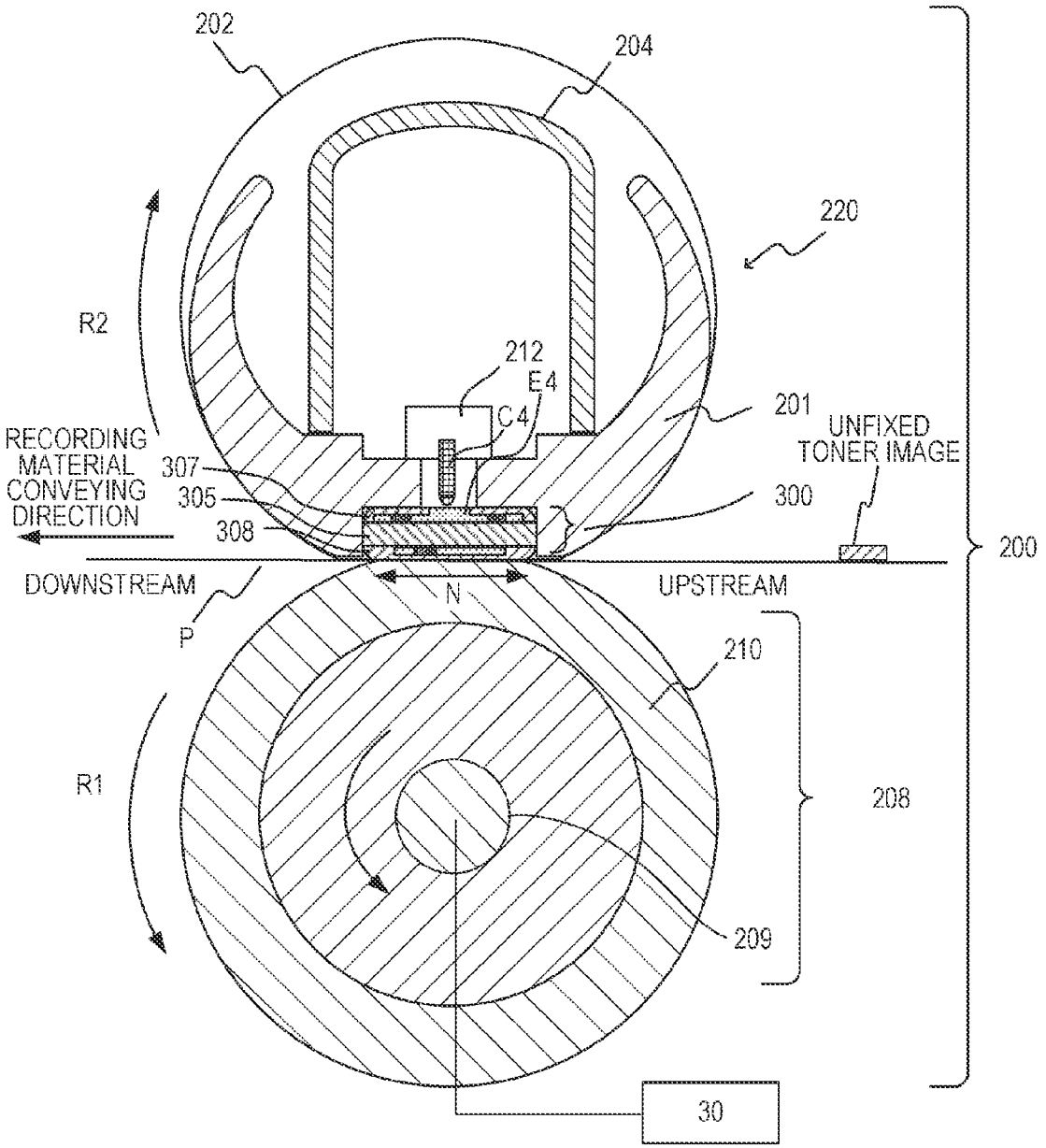
FIG. 2 is a schematic cross-sectional view of a fixing apparatus of an embodiment of the present invention.

FIG. 2 is a cross-sectional view of the fixing apparatus 200, which is the image heating apparatus of Embodiment 1. The fixing apparatus 200 includes: a fixing film 202, which is an endless belt; a heater 300, which is disposed on the inner side of the fixing film 202; a pressure roller 208, which forms a fixing nip portion N with the heater 300 via the fixing film 202; and a metal stay 204. The fixing film 202 is a flexible cylindrical multilayer heat resistant film, of which base layer can be 50 to 100 μm thick heat resistant resin (e.g. polyimide), or 20 to 50 μm thick metal (e.g. stainless steel). A release layer is disposed on the surface of the fixing film 202 to prevent the adhesion of toner, and to ensure separation from the recording material P, and the release layer is a heat resistant resin which excels in releasability, such as a 10 to 50 μm thick tetra fluoroethylene-perfluoro alkyl vinyl ether copolymer (PFA). In the case of an apparatus that forms color images, in particular, a heat resistant rubber (e.g. silicon rubber) of which thickness is about 100 to 400 μm and thermal conductivity is about 0.2 to 3.0 W/m·K may be disposed as an elastic layer between the base layer and the release layer, so as to improve image quality.

In Embodiment 1, in terms of thermal response, image quality, durability, and the like, polyimide, of which thickness is 60 μm, is used for the base layer, silicon rubber, of which thickness is 300 μm and thermal conductivity is 1.6 W/m·K, is used for the elastic layer, and PFA, of which thickness is 30 μm, is used for the release layer.

The pressure roller 208 includes a core metal 209 formed of iron, aluminum or the like, and an elastic layer 210 formed of silicon rubber or the like. The heater 300 is held by a heater holding member 201 formed of heat resistant resin, and heats the fixing film 202. The heater holding member 201 also has a guide function which guides the rotation of the fixing film 202. The metal stay 204 receives pressing force (not illustrated), and energizes the heater holding member 201 toward the pressure roller 208. The pressure roller 208 receives power from the motor 30, and rotates in the arrow R1 direction. By the rotation of the pressure roller 208, the fixing film 202 rotates in the arrow R2 direction. In the fixing nip portion N, the recording material P is held and conveyed while receiving heat of the fixing film 202, whereby the unfixed toner image on the recording material P is fixed.

The heater 300 is a heater which is heated up by heating elements disposed on a ceramic substrate 305. The heater 300 includes a surface protective layer 308 which is disposed on the side of the fixing nip portion N, and a surface protective layer 307 which is disposed on the opposite side of the fixing nip portion N. A plurality of electrodes (electrode E4 is indicated here as a representative) and a plurality of electric contacts (electric contact C4 is indicated here as a representative) are disposed on the opposite side of the fixing nip portion N, so that power is supplied from each electric contact to each electrode. The heater 300 will be described in detail later with reference to FIG. 3 FIGS. 3A to 3C. A safety element 212 (e.g. thermoswitch, thermal fuse), which is activated by overheating of the heater 300 and shuts the power to be supplied to the heater 300 OFF, is disposed so as to directly contact the heater 300 or to indirectly contact the heater 300 via the heater holding member 201. In Embodiment 1, the heater 300, the heater holding member 201, the metal stay 204 and the like constitute the heater unit 220, which contacts the inner surface of the cylindrical fixing film 202.

Configuration of Heater

Figure 3A:
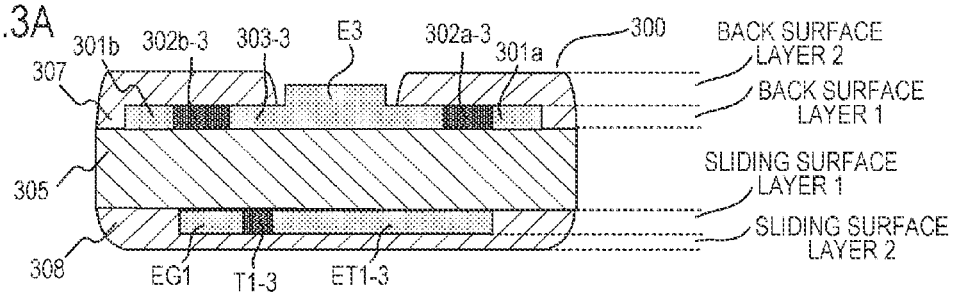
FIG. 3A to FIG. 3C are diagrams depicting a configuration of a heater of an embodiment of the present invention.
Figure 3B:
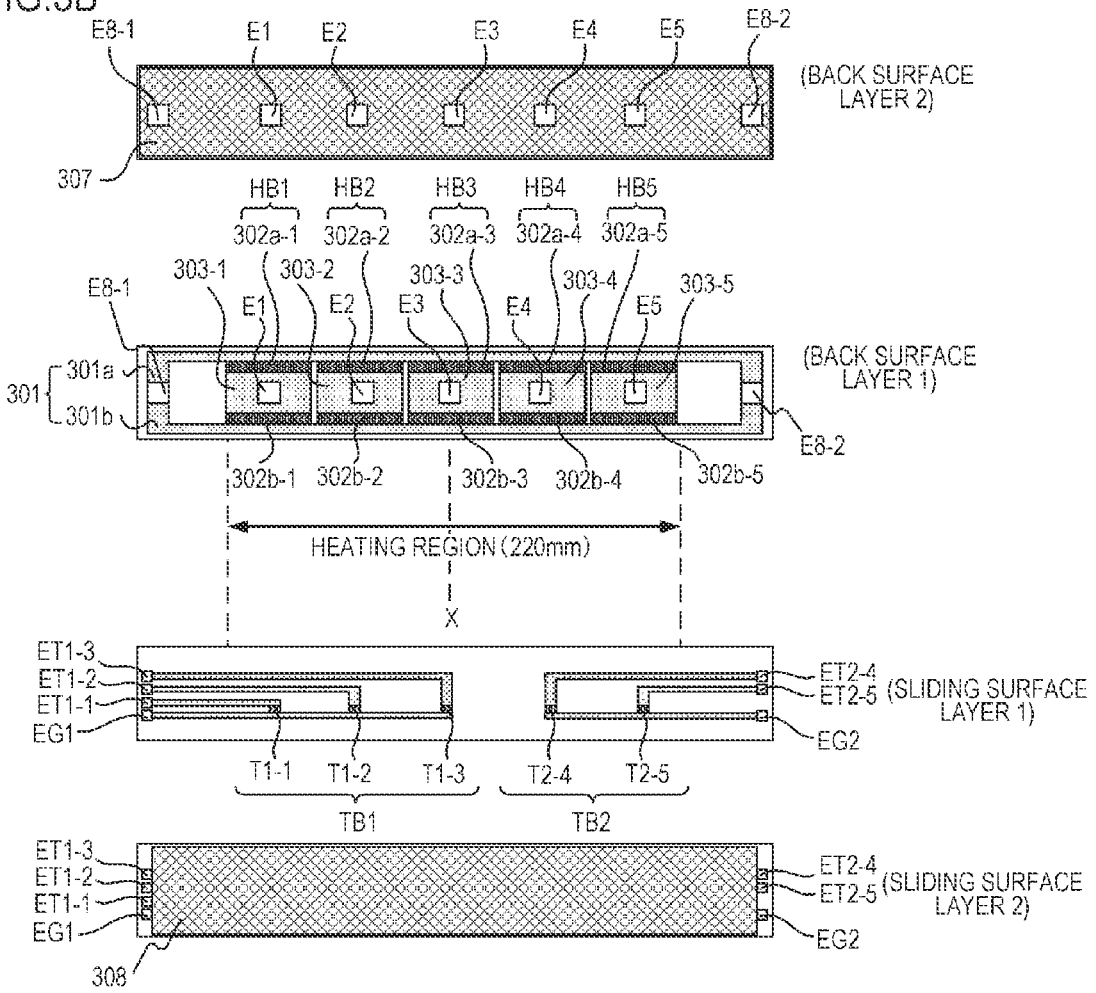
Figure 3C:
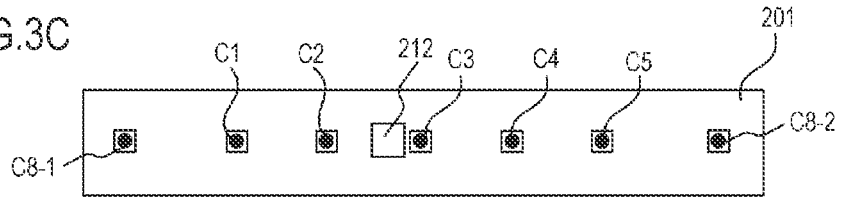

In FIGS. 3A to 3C, the heater 300 of Embodiment 1 is illustrated. FIG. 3A is a cross-sectional view at a conveyance reference position X indicated in FIG. 3B. The conveyance reference position X here is a reference position to convey the recording material P. In Embodiment 1, the recording material P is conveyed such that the center portion thereof passes through the conveyance reference position X. The heater 300 includes: first conductors 301 (301*a*, 301*b*) which are disposed on the substrate 305 on the back surface layer side, along the longitudinal direction of the heater 300; and second conductors 303 (303-3 is disposed at the conveyance reference position X) which are disposed on the substrate 305 along the longitudinal direction of the heater 300, at positions which are different from the first conductors 301 in the shorter direction of the heater 300. The first conductors 301 are divided into the conductors 301*a* which are disposed on the upstream side in the conveying direction of the recording material P, and the conductors 301*b* which are disposed on the downstream side thereof. Further, the heater 300 includes heating resistors 302, each of which is disposed between the first conductor 301 and the second conductor 303, and is heated up by power supplied via the first conductor 301 and the second conductor 303. The heating resistors 302 are divided into the heating resistors 302*a* (302*a*-3 is disposed at the conveyance reference position X), which are disposed on the upstream side in the conveying direction of the recording material P, and the heating resistors 302*b* (302*b*-3 is disposed at the conveyance reference position X), which are disposed on the downstream side thereof. An insulating surface protective layer 307 (glass in Embodiment 1), which covers the heating resistors 302, the first conductors 301 and the second conductors 303 (303-3 is disposed at the conveyance reference position X), is disposed on the back surface layer 2 of the heater 300, so as to avoid electrode portions E (E3 is disposed at the conveyance reference position X).

FIG. 3B is a plan view of each layer of the heater 300. A plurality of heating blocks (each heating block is constituted of a set of the first conductor 301, the second conductor 303 and the heating resistor 302) are disposed on the back surface layer 1 of the heater 300 in the longitudinal direction of the heater 300. The heater 300 of Embodiment 1 includes a total of five heating blocks HB1 to HB5 in the longitudinal direction of the heater 300. In FIG. 3B, the heating region is from the left end of the heating block HB1 to the right end of the heating block HB5, and the length thereof is 220 mm. In Embodiment 1, the width of each heating block in the longitudinal direction is the same (however, all the widths in the longitudinal direction need not be the same). The heating blocks HB1 to HB5 are constituted of the heating resistors 302*a*-1 to 302*a*-5 and the heating resistors 302*b*-1 to 302*b*-5, which are formed to be symmetric with respect to the shorter direction of the heater 300 respectively. The first conductor 301 on the back surface layer 1 is constituted of a conductor 301*a* which is connected with the heating resistors (302*a*-1 to 302*a*-5) and a conductor 301*b* which is connected with the heating resistors (302*b*-1 to 302*b*-5). In the same manner, the second conductor 303 is divided into five (conductors 303-1 to 303-5) in order to support the five heating blocks HB1 to HB5. Electrodes E1 to E5 are electrodes used to supply power to the heating blocks HB1 to HB5 via the conductors 303-1 to 303-5. The electrodes E8-1 and E8-2 are electrodes used to connect to a common electric contact, which is used to supply power to the five heating blocks HB1 to HB5 via the conductor 301*a* and the conductor 301*b*. In Embodiment 1, the electrodes E8-1 and E8-2 are disposed on both ends in the longitudinal direction respectively, but only the electrode E8-1 may be disposed on one end, or different electrodes may be disposed on the upstream and the downstream in the conveying direction of the recording material respectively.

The surface protective layer 307 on the back surface layer 2 of the heater 300 is formed to exclude the areas of the electrodes E1 to E5, E8-1 and E8-2, so that the electric contacts C1 to C5, C8-1 and C8-2 can be connected to each electrode from the back surface layer side of the heater 300 respectively, and power can be supplied to the heater 300 from the back surface layer side. Further, in this configuration, the power to be supplied to at least one of the heating blocks and the power to be supplied to the other heating blocks can be independently controlled. By disposing the electrodes on the back surface of the heater 300, wiring using conductive patterns on the substrate 305 is not required, and the width of the substrate 305 in the shorter direction can be shortened. Therefore, the material cost of the substrate 305 can be reduced, and the rise time required for increasing the temperature of the heater 300 can be reduce because the thermal capacity of the substrate 305 can be decreased. The electrodes E1 to E5 are disposed within a region where the heating resistors are disposed in the longitudinal direction of the substrate.

A sliding surface layer 2 on the side of the sliding surface (surface that contacts the fixing film) of the heater 300 includes a surface protective layer 308 (glass in Embodiment 1) which has slidability. In order to dispose electric contacts for the conductors ET1-1 to ET1-3, ET2-4 and ET2-5 for detecting resistance values of the thermistors, and common conductors EG1 and EG2 for the thermistors, the surface protective layer 308 is disposed at least on a region that slides with the fixing film 202, excluding both ends of the heater 300. The thermistors T1-1 to T1-3 and thermistors T2-4 and T2-5 are disposed on the sliding surface layer 1 as temperature detecting units (temperature detecting portions) to detect the temperature of each heating block HB1 to HB5 of the heater 300. Each thermistor is formed of material having PTC characteristics or NTC characteristics (NTC characteristics in the case of Embodiment 1), which is thinly formed on a substrate. Since each heating block HB1 to HB5 includes a thermistor, the temperature of all the heating blocks can be detected by detecting the resistance value of each thermistor. In order to energize the three thermistors T1-1 to T1-3, the conductors ET1-1 to ET1-3 for detecting the resistance values of the thermistors and a common conductor EG1 of the thermistors are disposed, and by a set of these conductors and the thermistors T1-1 to T1-3, a thermistor block TB1 is formed. In the same manner, in order to energize the two thermistors T2-4 and T2-5, the conductors ET2-4 and ET2-5 for detecting the resistance values of the thermistors and a common conductor EG2 of the thermistors are disposed, and by a set of these conductors and the thermistors T2-4 and T2-5, a thermistor block TB2 is formed.

As illustrated in FIG. 3C, holes connecting the electrodes E1 to E5, E8-1 and E8-2 and the electric contacts C1 to C5, C8-1 and C8-2 are disposed on the holding member 201 of the heater 300. The above mentioned safety element 212 and the electric contacts C1 to C5. C8-1 and C8-2 are disposed between the stay 204 and the holding member 201. The electric contacts C1 to C5, C8-1 and C8-2 that contact the electrodes E1 to E5, E8-1 and E8-2 are electrically connected to the respective electrode portions of the heater respectively by such a method as energizing force of a spring or welding. Each electric contact is connected to the later mentioned control circuit 400 of the heater 300 via a cable or such conductive materials as a thin metal plate, which is disposed in a space between the stay 204 and the holding member 201. The electric contacts disposed in the conductors ET1-1 to ET1-3, ET2-4 and ET2-5 for detecting the resistance values of the thermistors, and the electric contacts disposed in the common conductors EG1 and EG2 for the thermistors are also connected to the later mentioned control circuit 400.

Overview of Heater Control Method

In the image forming apparatus of Embodiment 1, power to be supplied to each of the five heating blocks HB1 to HB5 of the heater 300 is individually controlled to the optimum in accordance with the image data (image information) sent from such an external device as a host computer (not illustrated) so that an image portion is selectively heated. The power to be supplied to each of the heating blocks HB1 to HB5 is determined by the control portion 113, with reference to a control target temperature (hereafter "control temperature TGT") that is set as a heating parameter for each heating block HB1 to HB5.

The temperature control is performed so that the detected temperatures by the thermistors T1-1 to T2-5, corresponding to the heating blocks HB1 to HB5, become the same as the control temperature TGT, which is set for the heating blocks HB1 to HB5 individually. The control temperature TGT for an image formed at a position corresponding to each of the heating blocks HB1 to HB5 is determined depending on the type of image. In Example 1, the control temperature TGT is determined based on the image data (image information), so that as the image requires more toner, the image is heated at a higher temperature.

Figure 4:
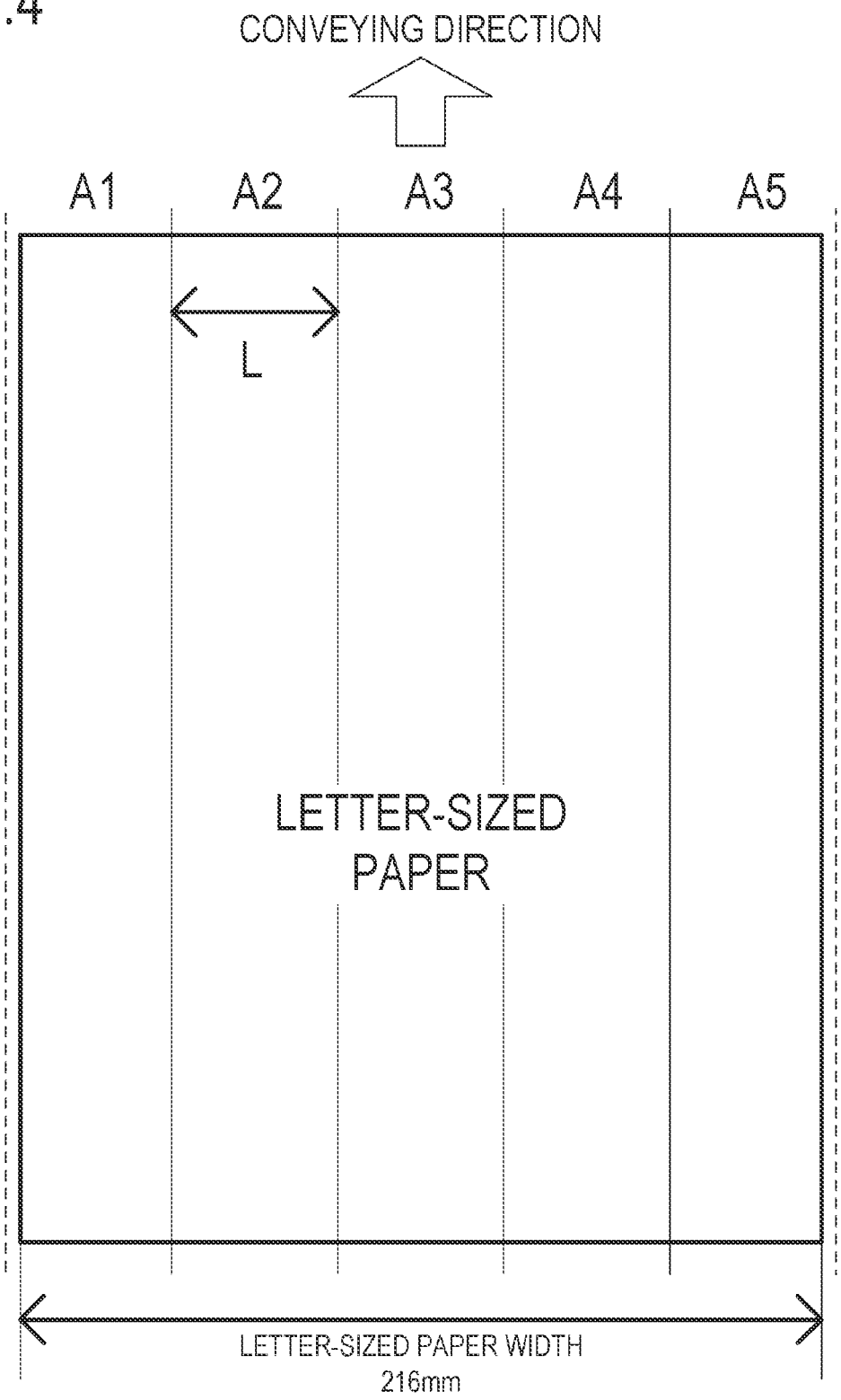
FIG. 4 is a schematic explanatory diagram of a heater control method of Embodiment 1.

FIG. 4 is a diagram indicating five heating regions A1 to A5, which are set by dividing a recording material into five along the longitudinal direction, in comparison with the size of letter-sized paper. The heating regions A1 to A5 correspond to the heating blocks HB1 to HB5, so that the heating region A1 is heated by the heating block HB1, and the heating region A5 is heated by the heating block HB5. The total length of the heating regions A1 to A5 is 220 mm, and each region is determined by equally dividing this total length into five (L=44 mm).

Configuration of Heater Control Circuit

Figure 5:
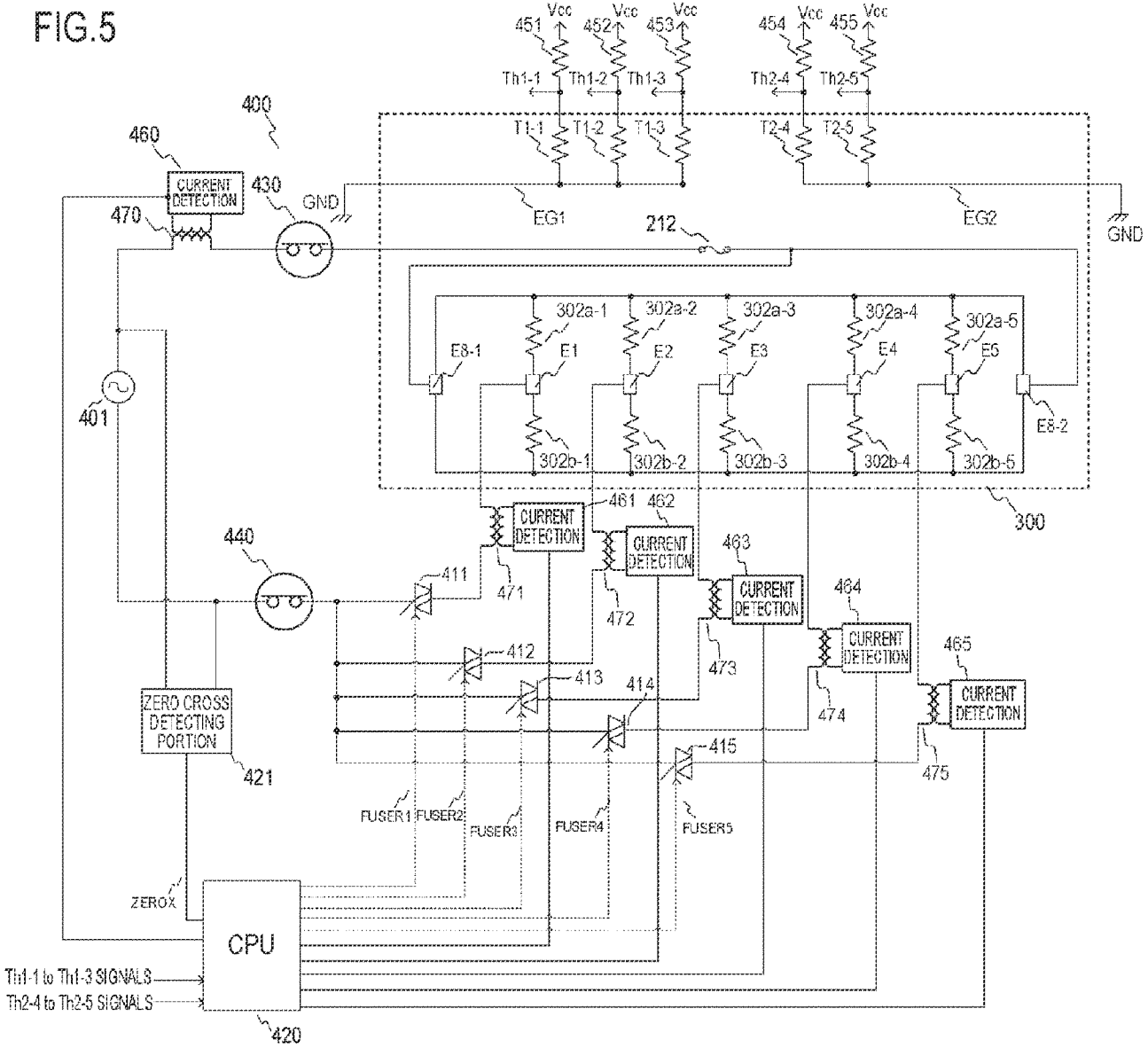
FIG. 5 is a block diagram of an electric circuit according to Embodiment 1.

FIG. 5 is a circuit diagram of the control circuit 400 which is a control portion of the heater 300 of Embodiment 1. A Central Processing Unit (CPU) 420 is a composing element of the control portion 113 of the image forming apparatus, and drives the control circuit 400. 401 indicates a commercial Alternating Current (AC) power supply which is connected to the image forming apparatus 100. Power of the heater 300 is controlled by the ON/OFF of the triac 411 to triac 415. The triacs 411 to 415 operate in accordance with the FUSER 1 to FUSER 5 signals from the CPU 420 respectively. The drive circuits of the triacs 411 to 415 are omitted. The control circuit 400 of the heater 300 has such a circuit configuration that the five heating blocks HB1 to HB5 can be independently controlled by the five triacs 411 to 415.

A zero cross detecting portion 421 is a circuit to detect the zero cross of the AC power supply 401, and outputs a ZEROX signal to the CPU 420. The ZEROX signal is used to detect timings to control the phases and wave numbers of the triacs 411 to 415, for example.

The temperature detection method of the heater 300 will be described. For the temperatures detected by the thermistors T1-1 to T1-3 of the thermistor block TB1, divided voltage values determined using the thermistors T1-1 to T1-3 and the resistors 451 to 453 are detected by the CPU 420 as Th1-1 to Th1-3 signals. In the same manner, for the temperatures detected by the thermistors T2-4 and T2-5 of the thermistor block TB2, divided voltage values determined using the thermistors T2-4 and T2-5 and resistors 454 and 455 are detected by the CPU 420 as Th2-4 and Th2-5 signals.

In the internal processing of the CPU 420, power to be supplied is calculated based on the setting temperature of each heating block and the detected temperature of each thermistor using proportional integral (PI) control, for example. Further, the power to be supplied is converted into a corresponding control level of the phase angle (phase control) on the wave number (wave number control), and the triacs 411 to 415 are controlled based on these control conditions. A relay 430 and a relay 440 are used as units to interrupt power to the heater 300 in the case where the heater 300 overheats due to failure, or the like.

A current transformer 470 converts the primary total current that flows into the image forming apparatus 100 into a voltage value. The current-voltage conversion result is converted into an effective value by a current detecting circuit 460 (current detecting portion), and the result is outputted to the CPU 420. Current transformers 471 to 475 convert the current that flows into the heating blocks HB1 to HB5 into voltage values respectively. The current-voltage conversion results are converted into effective values by the current detecting circuits 461 to 465 respectively, and the results are outputted to the CPU 420.

Current Limiting Control Using Current Detection Circuit

Figure 6:
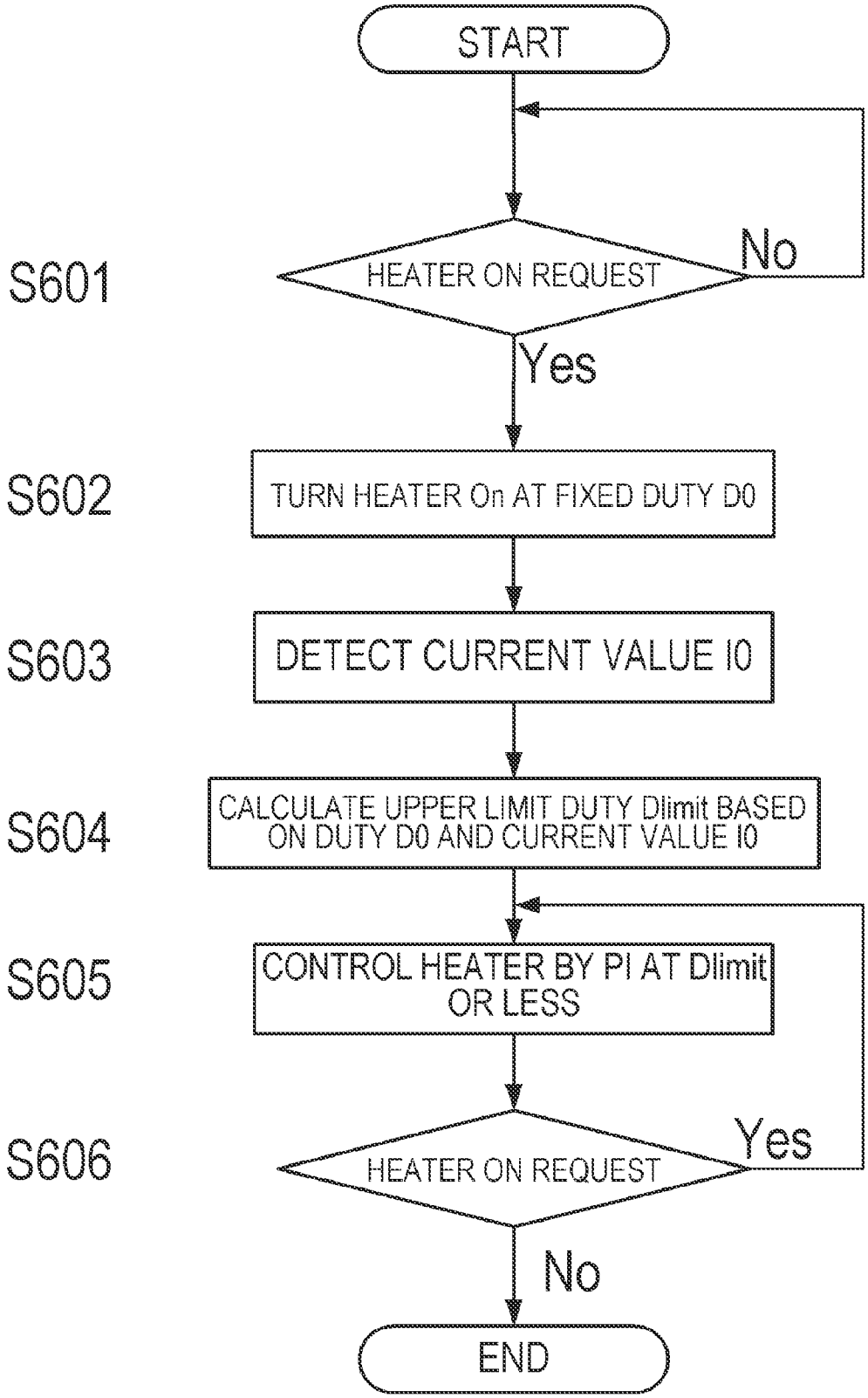
FIG. 6 is a control flow chart according to Embodiment 1.

Based on the above mentioned current detection method, the image forming apparatus performs the following current limiting control so that the current flowing to the heater does not exceed a predetermined limit value. A specific current limit control flow will be described with reference to FIG. 6. When a request to start the power supply to the heater is generated (S601), the heating elements are energized at a predetermined fixed duty D0 (S602). In a case of performing phase control here, a phase angle α has been predetermined corresponding to the energizing duty D (%), as indicated in Table 1 below, and the CPU 420 controls the heater based on this control table.

TABLE 1

| Power ratio duty D (%) | Phase angle α (°) |
|---|---|
| 100 | 0 |
| 97.5 | 28.56 |
| . | . |
| . | . |
| . | . |
| 75 | 66.17 |
| . | . |
| . | . |
| . | . |

TABLE 1-continued

| Power ratio duty D (%) | Phase angle α (°) |
|---|---|
| 50 | 90 |
| . | . |
| . | . |
| . | . |
| 25 | 113.83 |
| . | . |
| . | . |
| . | . |
| 2.5 | 151.44 |
| 0 | 180 |

Current is supplied to the heater at a phase angle α1 corresponding to the fixed duty D0. While the heater is being energized at the fixed duty D0, the effective value of the current value I0 computed by the current detecting circuit 460 (S603) is detected. The fixed duty D0 is set so as not to exceed the allowable current, considering the input voltage range that is assumed and the dispersions of the heating element resistance values. In other words, the fixed duty D0 is set assuming the case where the input voltage is at the maximum, and the resistance value is at the minimum.

The CPU 420 acquires the suppliable upper limit power duty Dlimit (hereafter "limit duty") based on the detected current value I0, the fixed duty D0 and the suppliable current value Ilimit (hereafter "limit current") (S604). Dlimit is calculated by the following Expression 1.

$$Dlimit=(Ilimit/I0)^2\times D0 \quad \text{(Expression 1)}$$

For the limit current value Ilimit, an allowable current value that is suppliable to the heater 300 is set, which is determined by subtracting the current supplied to portions other than the heater 300 from the rated current of the commercial power supply to be connected. The CPU 420 determines the lighting duty that is supplied the next time by the PI control, based on the difference between the predetermined target temperature and the actual temperature detected by the thermistor. If the duty calculated here exceeds the limit duty Dlimit, power is supplied setting the lighting duty the next time to Dlimit (S605). In other words, the PI control is performed at a duty that is not more than the limit duty Dlimit. Then it is determined whether a request to start supplying power to the heater is generated, and the image forming operation is ended if no request is generated (S606).

Heater Startup Control and Fixing Processing Control

In Embodiment 1, based on a predetermined limit duty Dlimit determined by the current detecting circuit 460 which detects current supplied to the heater 300, control to supply constant power is performed. The value of Dlimit differs depending on the value of the input voltage, but the power which is supplied in the case of turning the heater ON at the duty of Dlimit becomes a same value even if the voltage value is different, and as long as the resistance value of the hater is the same. In other words, if the heater is turned ON at the duty of Dlimit, the limit current Ilimit flows to the heater, hence the power of $Wlimit=Ilimit^2\times Rt$ (combined resistance value of the heater 300) is supplied. The heater 300 of Embodiment 1 includes five heating blocks which can be controlled independently, but Dlimit is a same value for all the heating blocks. This is because, in the case where the temperature of the environment where the image forming apparatus is set (room temperature) is about the same as the temperature of the fixing apparatus in the initial state, where the temperature of the fixing apparatus is not higher than a predetermined temperature, the rise time of the fixing apparatus can be shortened, and time until the first print is outputted can be minimized.

Figure 7A:
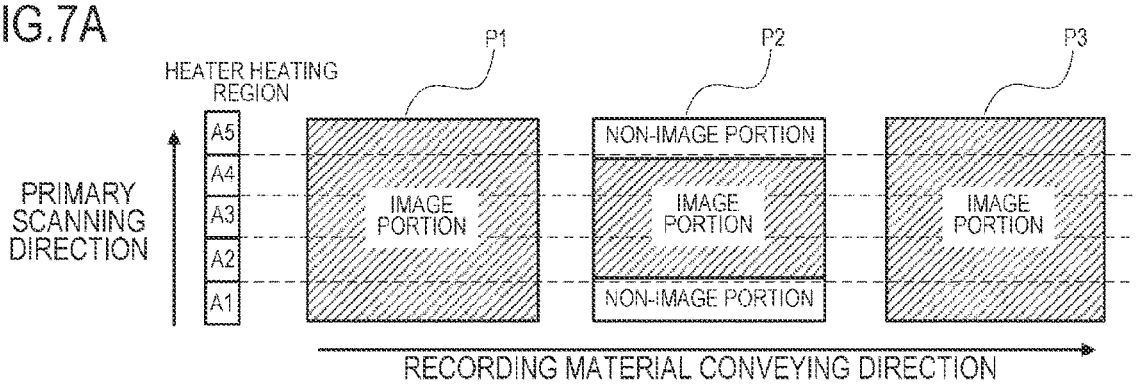
FIG. 7A to FIG. 7E are operation diagrams of fixing processing according to Embodiment 1.
Figure 7B:
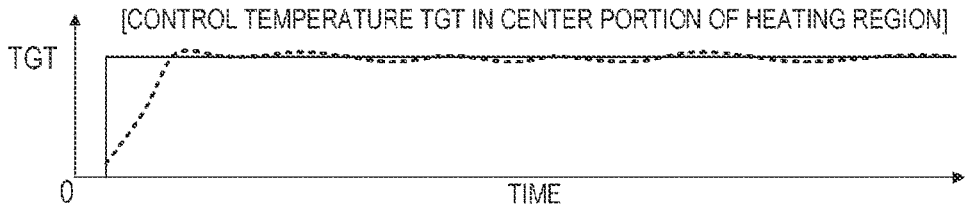
Figure 7C:
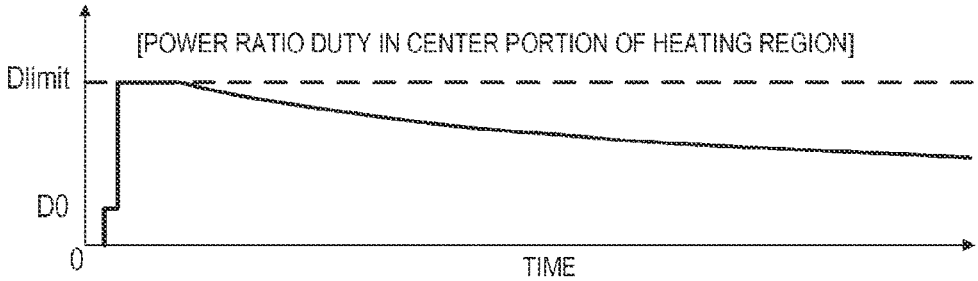

Now a control in a case of continuously performing the fixing processing on a plurality of recording materials (continuous image forming) will be described using an example of continuously fixing three pages (three sheets) of which regions of the image portion formed on the recording material are different, as illustrated in FIG. 7A. By the time when the first page (first sheet) of the recording material P1 reaches the fixing portion (first period), the above mentioned startup control is performed. In a period from the arrival of the recording material P1 at the fixing unit to end the image forming operation (second period), the following control is performed. The first page (first sheet) of the recording material P1 has an image portion on the entire surface, and all of A1 to A5 are heating regions (image heating regions), where heating elements, to heat these heating regions, correspond to the first heating elements of the present invention. In the second page (second sheet) of the recording material P2 (first recording material), the imaging portions are A2, A3 and A4 (hereafter "center portion"), and A1 and A5 (hereafter "both end portions") are non-image portions where images are not formed. In other words, A1 and A5 correspond to the non-image heating regions, and the heating elements to heat A1 and A5 correspond to the second heating elements of the present invention. Further, the third page (third sheet) of the recording material P3 (second recording material), has an image portion on the entire surface, just like the case of P1. At this time, the temporal change of the control temperature TGT of the heater in the center portion of the heating region is indicated by the solid line in FIG. 7B. In the center portion of the heating region, an image portion continues for all three pages, hence the control temperature TGT has a constant value. The broken line in FIG. 7B indicates the change of the detected temperature of the thermistors, and is approximately a temperature of the control temperature TGT. FIG. 7C indicates the temporal change of the energizing duty in the central portion of the heating region. When the heater ON request is received, the fixed duty D0 is supplied, and the limit duty Dlimit is calculated. In Embodiment 1, the heating regions A2, A3 and A4 can be energized independently, but the heat value is the same for all of these regions, hence D0 is the same value, and the calculated value of Dlimit also becomes the same. After Dlimit is calculated, the heating regions are energized at the first maximum energizing duty (Dlimit) in order to startup the fixing apparatus to be a fixable state. After a predetermined temperature reaches a temperature that is lower than the control temperature TGT by the preset temperature, the image forming operation starts, and the conveyance of the recording material P1 is started. When the fixing processing on the recording material P1 is started, a power ratio duty is determined by the P1 control, so that the thermistor temperature becomes the control temperature TGT. The amount of heat generated by the heater is mainly used for heating the recording material and the heating of the fixing apparatus itself. A constant amount of heat is conducted every second to the recording material, which is being conveyed at a constant speed, but the amount of heat that is conducted to the fixing apparatus, which stores heat from the heating, gradually decreases. Therefore the amount of heat that is transferred from the heater due to conduction decreases as time elapses, and as indicated in FIG. 7C, the energizing duty gradually decreases.

Figure 7D:
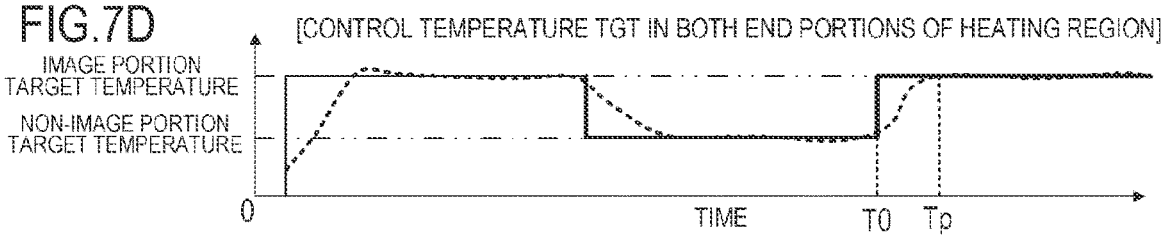
Figure 7E:
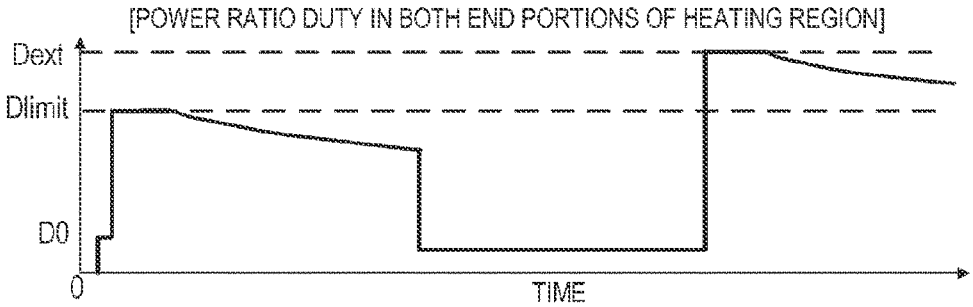

The solid line in FIG. 7D indicates the temporal change of the control temperature TGT on both end portions of the heating region. Since an image is formed on both end portions (A1, A5) of the heating region of the recording material P1, the control temperature TGT changes at the same values as the center portion of the region. In the recording material P2, on the other hand, both end portions of the heating region are non-image portions where no image is formed, hence the control temperature TGT is set to a low value (non-image portion target temperature). Further, in the recording material P3, both end portions of the heating region are image portions, hence the control temperature TGT is set to the same control temperature TGT as the recording material P1 (image portion target temperature). The broken line in FIG. 7D indicates the change of the thermistor temperature in this case. FIG. 7E indicates the temporal change of the power ratio duty on both end portions of the heating region. Energization at the fixed duty D0 after the heater ON request is received and calculation of the limit duty Dlimit are the same as the case of the center portion of the heating region, and the power ratio duty, when the fixing processing is performed on the recording material P1, is also the same as the case of the center portion of the heating region. In the case of performing the fixing processing on the recording material P2, both end portions of the heating region are non-image portions, hence the control temperature TGT is set to a low value. Therefore the energizing duty in this case is also set to a low value by the PI control.

In the case of performing the fixing processing on the recording material P3, both end portions of the heating region are image portions, hence the control temperature TGT is set to the same temperature as the receiving material P1. In this case, the temperature of the heater must be increased from the temperature of the non-image portion to the temperature of the image portion, and therefore the higher the energizing duty the better. However, if the energizing duty is set to the limit duty Dlimit, the energizing duty is not always at the maximum. In Embodiment 1, Dlimit is calculated to a value such that even if the energizing duties of all the heating regions A1 to A5 are set to Dlimit, the allowable current of the commercial power supply is not exceeded. On the other hand, in the case of performing the fixing processing on the recording material P3, the energizing duties of the center portion (A2, A3 and A4) of the heating region are smaller than Dlimit. This means that even if the energizing duties of both end portions (A1 and A5) of the heating region are set to Dlimit, the allowable current value of the commercial power supply is not reached. As a consequence, in the case of performing the fixing processing on the recording material P3, Dext, which is calculated by the following Expression 2, is acquired as the second maximum energizing duty.

$$Dext = D\text{limit} + (I\text{limit} - I2 - I3 - I4)/10)^2 \times D0 + 2 \quad \text{(Expression 2)}$$

I2: current that flows through the heating region A2
I3: current that flow through the heating region A3
I4: current that flows through the heating region A4

Figure 8:
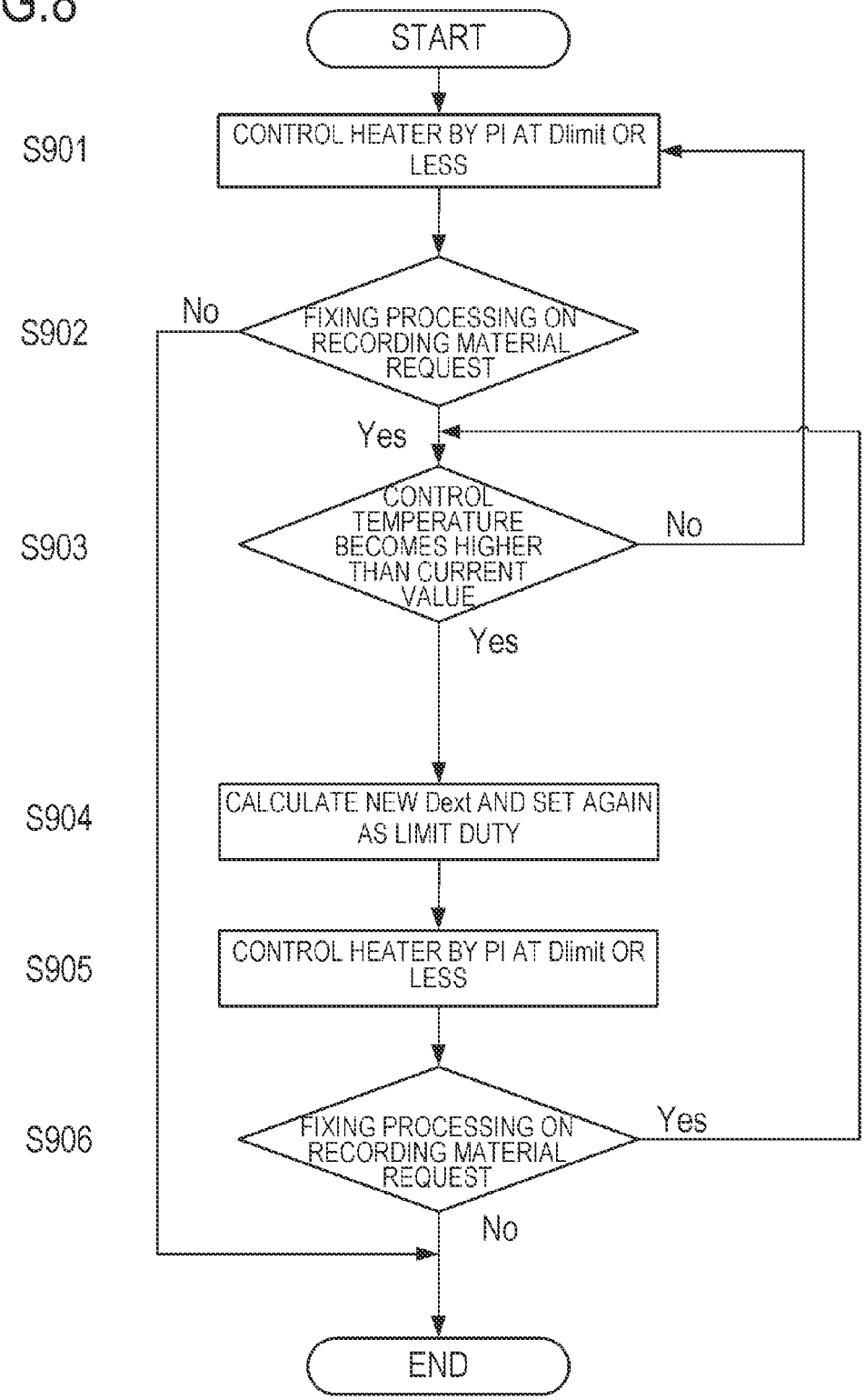
FIG. 8 is a control flow chart according to Embodiment 1.

By setting the energizing duty to Dext while the temperature of the recording material P3 is increased to the control temperature TGT to perform the fixing processing, power higher than the case of Dlimit is supplied, hence a quicker startup becomes possible. Even if the energizing duty of each heating element of the heating regions A1 and A5 is set to Dext, which is higher than Dlimit, the total of the current values of all the heating elements does not exceed the allowable maximum current value, because the energizing duty of each element of the heating regions A2, A3 and A4 is a smaller value than Dlimit (FIG. 7C). FIG. 8 is a control flow during paper feeding described above. In the state where the heater is PI-controlled at not more than Dlimit (S901), processing advances to S903 if the fixing processing request for the next recording material is received, or the image forming operation is ended if not received (S902). Then in the case where the control temperature TGT of the recording material is not higher than the control temperature TGT of the current recording material, the PI control at not more than Dlimit is continued. On the other hand, in the case where the control temperature TGT of the recording material is higher than the control temperature TGT of the current recording material (S903), a new value of Dext is calculated and set again as the limit duty (S904). Then the heater is PI-controlled at the newly set not more than limit duty Dext (S905). If the fixing processing request for the next recording material is received (S906), the control temperature of this recording material is compared with the current control temperature. This control flow is performed for each heating region (A1 to A5).

Now a control flow of a comparative example will be described with reference to FIGS. 9A to 9E. The image forming regions of the recording materials P1, P2 and P3 are the same as Embodiment 1. The temperature control of the center portion of the image heating region (FIG. 9B and FIG. 9C) is also the same as Embodiment 1. For the temperature control for both end portions of the heating region, the limit duty remains as Dlimit even in the case of the recording material P3, as indicated in FIG. 9E. Therefore, even if the target control temperature TGT has risen after the fixing processing operation is performed on the recording material P2, as indicated in FIG. 9D, the energizing duty remains Dlimit, and this makes the temperature rising speed of the heater slow. This means that the conveyance start timing of the recording material P3 must be delayed until the recording material P3 reaches temperature at which the fixing processing is possible.

Figure 9A:
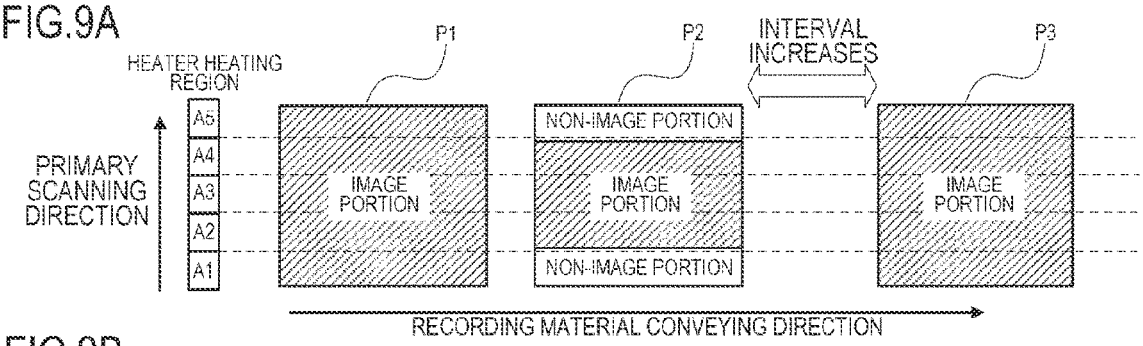
FIG. 9A to FIG. 9E are operation diagrams of fixing processing according to a comparative example.
Figure 9B:
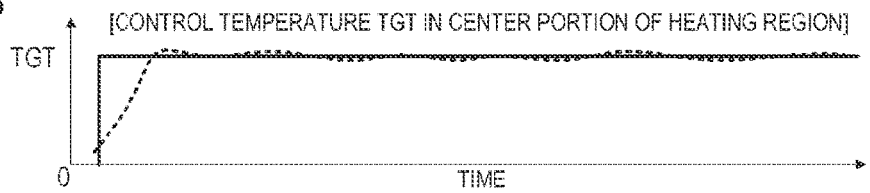
Figure 9C:
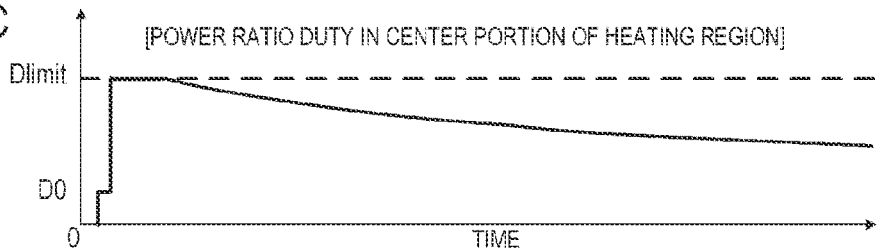
Figure 9D:
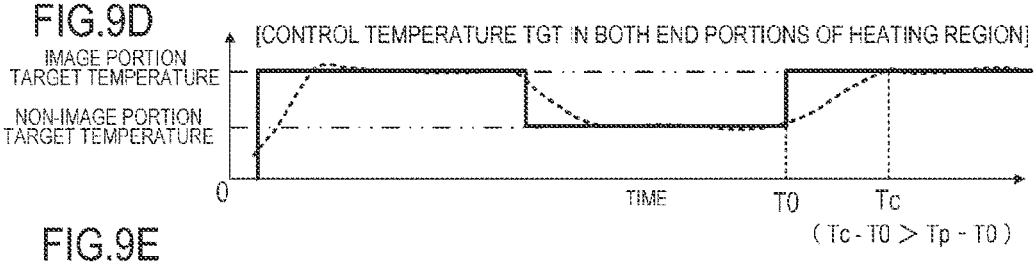
Figure 9E:
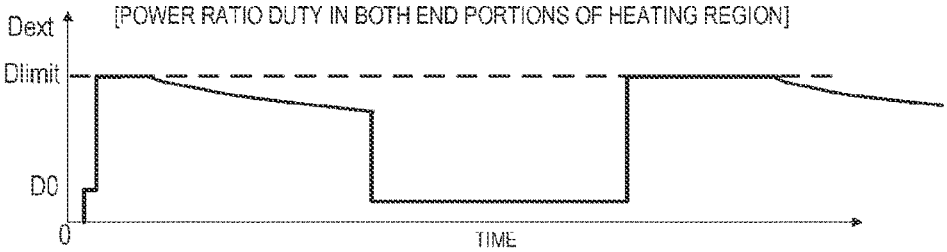

As a result, the interval between the recording materials P2 and P3 increases, as indicated in FIG. 9A, and productivity in terms of a number of prints of the image forming apparatus drops. In other words, as indicated in FIG. 7D, in the case of Embodiment 1, the time from the timing T0 when the energizing duty D0 is reset to Dext to the timing Tp when the detected temperature reaches the image portion target temperature, that is, (Tp-T0) becomes shorter than the time from the timing T0 to the timing Tc when the detected temperature reaches the image portion target temperature, that is, (Tc-T0), indicated in FIG. 9D (comparison example).

Further, in the case of the comparative example, if the timing to switch the control temperature TGT is quickened, when the recording material P2 is changed to P3 at the end portion of the heating region, printing can be performed without increasing the conveying interval between the recording materials P2 and P3. In this case, however, the temperature at the end portion of the heating region is increased while the fixing processing is performed on the recording material P2, hence the amount of heat that is transferred to the recording material P2 increases. In other words, since the end portion of the heating region of the recording material P2 is a non-image portion, unnecessary heat is consumed, which is not desirable in terms of energy saving.

As described above, by using the control flow of Embodiment 1, productivity in terms of a number of prints can be maintained while minimizing unnecessary energy consumption.

Embodiment 2

In Embodiment 2, unnecessary heat consumption is minimized by detecting the voltage of a commercial AC power supply connected to the image forming apparatus 100. Configuration of the image forming apparatus, the fixing apparatus and the heater of Embodiment 2 is the same as Embodiment 1, hence description thereof is omitted.

Figure 10:
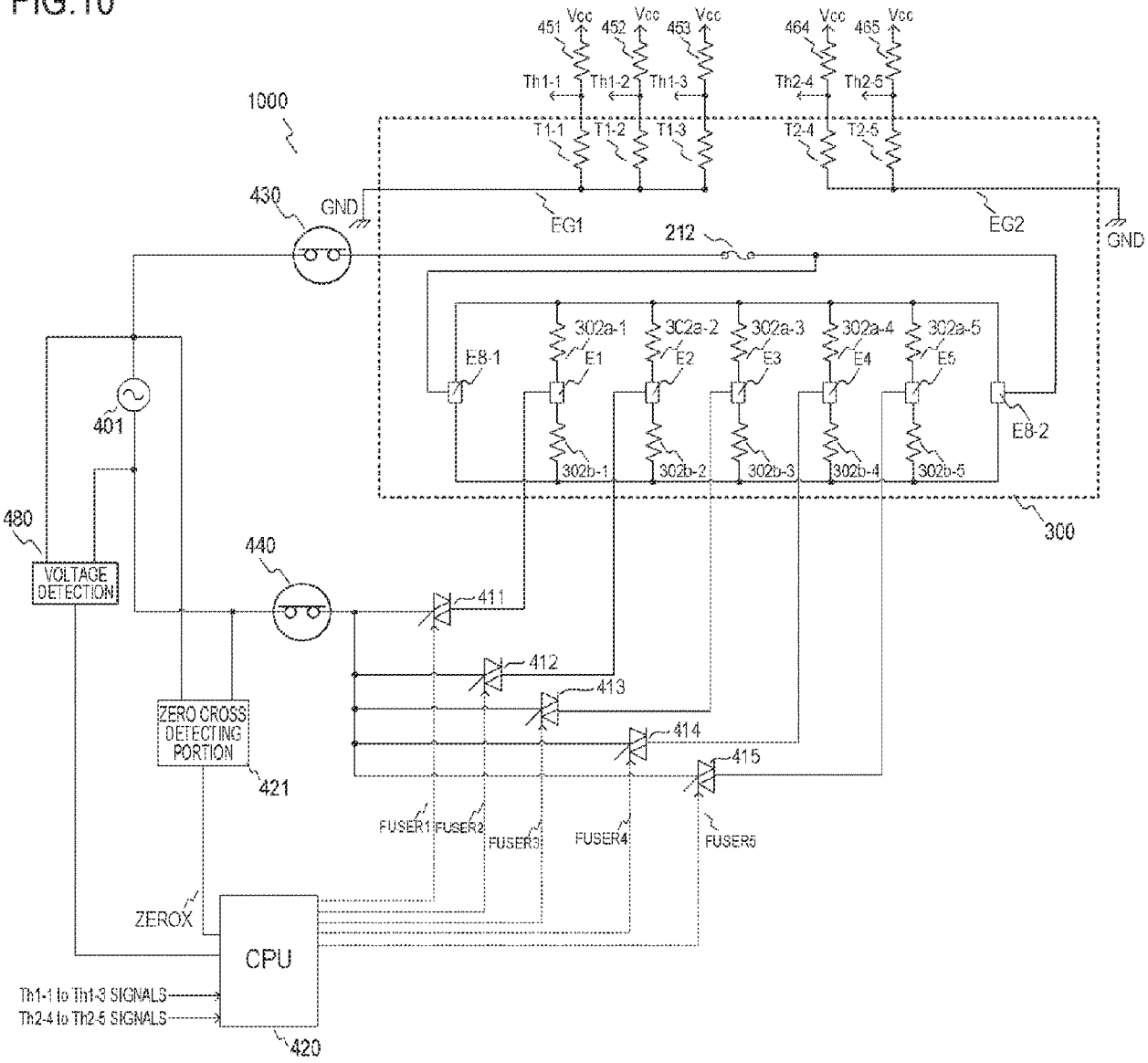
FIG. 10 is a block diagram of an electric circuit according to Embodiment 2.

FIG. 10 is a circuit diagram of the heater control circuit 1000 of Embodiment 2. A difference from Embodiment 1 is that the voltage of the power supply connected to the image forming apparatus is calculated by the voltage detecting circuit 480 (voltage detecting portion).

Current Limiting Control Using Voltage Detecting Circuit

Figure 11:
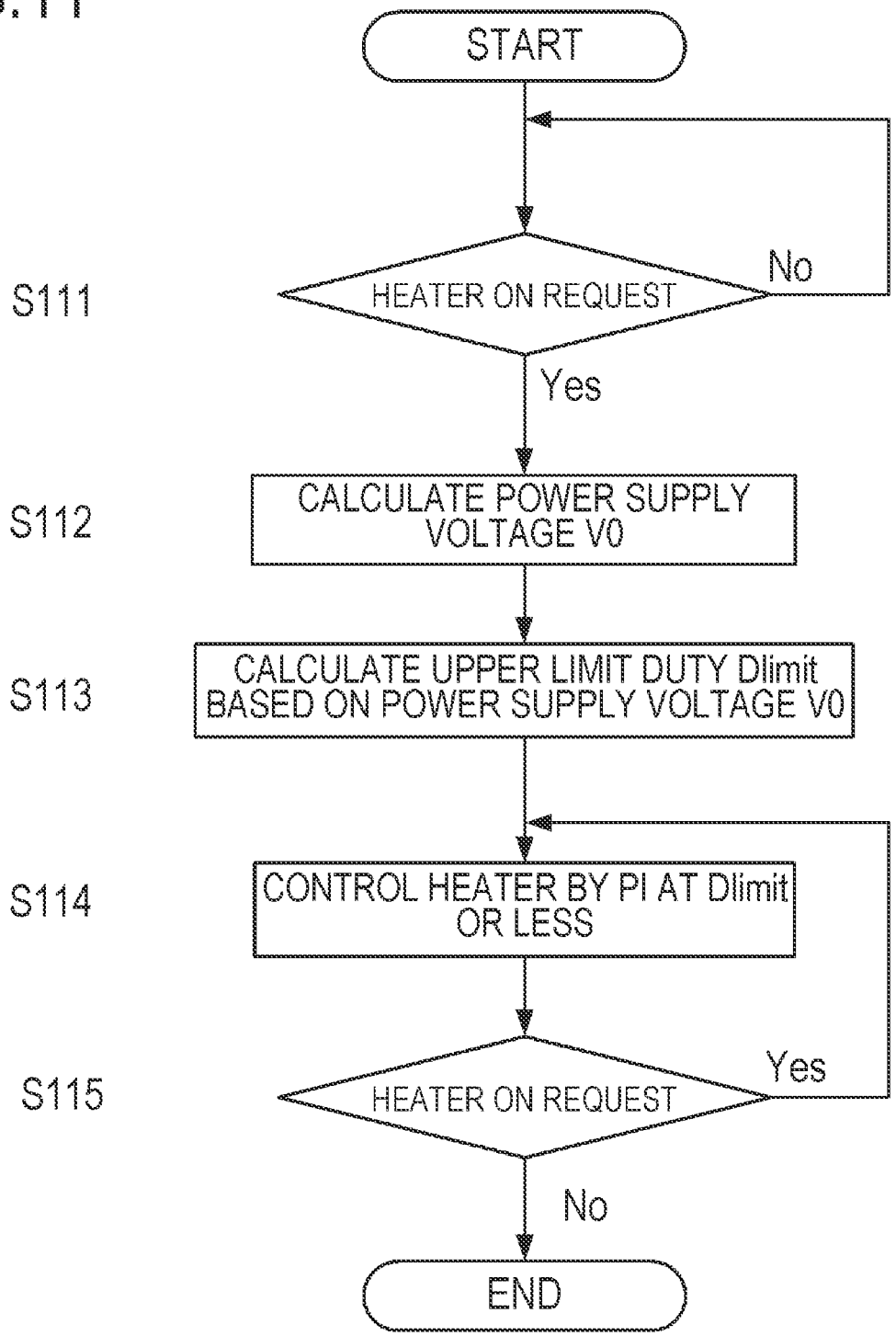
FIG. 11 is a control flow chart according to Embodiment 2.

Based on the above mentioned voltage detecting method, the image forming apparatus performs the following current limiting control so that the current flowing to the heater does not exceed a predetermined limit value. A specific control flow of the current limiting control will be described with reference to FIG. 11. When a request to start power supplying to the heater is generated (S111), the voltage detecting circuit calculates the voltage V0 of the commercial power supply (S112). Then using predetermined suppliable current value Ilimit and the combined resistance Rt of the heater which is measured in advance, the upper limit power ratio duty Dlimit that can be supplied is calculated (S113). In Embodiment 2, Dlimit is calculated by the following Expression 3.

$$Dlimit=(Ilimit\times Rt)+V0 \quad \text{(Expression 3)}$$

For the limit current value Ilimit, an allowable current value that can be supplied to the heater 300 is set, which is determined by subtracting the current supplied to portions other than the heater 300 from the rated current of the commercial power supply to be connected. The CPU 420 determines the lighting duty that is supplied the next time by the PI control, based on the difference between the predetermined target temperature and the actual temperature detected by the thermistor. If the duty calculated here exceeds the limit duty Dlimit, power is supplied so that the lighting duty the next time is Dlimit (S114). In other words, the PI control is performed at a duty not more than the limit duty Dlimit. Then it is determined whether a request to start supplying power to the heater is generated, and the image forming operation is ended if no request is generated (S115).

Heater Startup Control and Fixing Processing Control

In Embodiment 2, based on a limit duty Dlimit determined by the voltage detecting circuit 480 which detects the voltage of the commercial power supply, control to supply a constant power is performed. The value of Dlimit differs depending on the value of the input voltage, but the power which is supplied in the case of turning the heater ON at the duty of Dlimit becomes a same value even if the voltage value is different, as long as the resistance value of the heater is the same. In other words, if the heater is turned ON at the duty of Dlimit, the limit current Ilimit flows to the heater, hence the power of $Wlimit=Ilimit^2\times Rt$ is supplied. The heater 300 of the Embodiment 2 includes five heating blocks which can be controlled independently, but Dlimit is a same value for all the heating blocks. This is because in the case where the temperature of the environment where the image forming apparatus is set (room temperature) is about the same as the temperature of the fixing apparatus, the rise time of the fixing apparatus can be shortened, and time until the first print is outputted can be minimized.

Control when the fixing processing is performed on the recording materials is the same as Embodiment 1, hence description thereof is omitted. The recording materials on which the fixing processing is performed include an image portion and a non-image portion, as illustrated in FIG. 7A.

In the case of performing the fixing processing on the non-image portions (both end portions of the image region) of the recording material P3 in FIG. 7A according to Embodiment 2, not the limit duty Dlimit but Dext, which is calculated by the following Expression 4, is used.

$$Dext=Dlimit+(Ilimit-V0/R2-V0/R3-V0/R4)+V0\pm 2 \quad \text{(Expression 4)}$$

R2: resistance value of the heating block HB2
R3: resistance value of the heating block HB3
R4: resistance value of the heating block HB4

By setting the energizing duty to Dext while the temperature of the recording material P3 is increased to the control temperature TGT to perform the fixing processing, more power is supplied than in the case of Dlimit, hence a quicker startup becomes possible.

As described above, by using the control flow of Embodiment 2, productivity in terms of a number of prints can be maintained while minimizing unnecessary energy consumption.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-062729, filed on Mar. 31, 2020, which is hereby incorporated by reference herein in its entirety.

What is claimed is:

1. An image forming apparatus comprising:

an image forming portion configured to form an image on a recording material;

a fixing portion configured to heat the image and fix the image on the recording material, and including a plurality of heating elements arranged in a direction perpendicular to a conveying direction of the recording material;

a plurality of temperature detecting portions configured to individually detect temperatures of a plurality of heating regions which are heated by the plurality of heating elements respectively;

a control portion configured to individually control an energizing duty according to power supplied to a plurality of heating elements so that each of the temperatures detected by the plurality of temperature detecting portions maintain control target temperatures, the control portion setting a control target temperature of an image heating region, which is a region to heat an image portion where the image is formed in the recording material, out of the plurality of heating regions, as a first control target temperature and a control target temperature of a non-image heating region, which is a region to heat a non-image portion where the image is not formed in the recording material, out of the plurality of heating regions, as a second control target temperature, which is lower than the first control target temperature; and a current detecting portion configured to detect current that flows to the plurality of heating elements, wherein the control portion sets the energizing duty within a range of a maximum energizing duty, and in continuous image formation in which the images are continuously formed and fixed on a plurality of recording materials from an initial state where the temperature detected by the temperature detecting portion becomes not higher than a predetermined temperature, when a period from start of the continuous image formation on a first recording material, out of the plurality of recording materials, to arrival of the first recording material at the fixing portion, is regarded as a first period, and a period from the arrival of the first recording material at the fixing portion to the end of the continuous image formation is regarded as a second period, a second maximum energizing duty that is set when the control portion supplies power to the plurality of heating elements in the second period is higher than a first maximum energizing duty that is set when the control portion supplies power to the plurality of heating elements in the first period, and the second maximum energizing duty is switched from the first maximum energizing duty in the middle of the second period.

2. The image forming apparatus according to claim 1, wherein the maximum energizing duty, which is set in the first period, is set based on a current value detected by the current detecting portion and an allowable current value that is suppliable to the fixing portion in the image forming apparatus.

3. The image forming apparatus according to claim 1, wherein the maximum energizing duty that is set in the second period is set so that a total current value of current values of the plurality of heating elements detected by the current detecting portion does not exceed a predetermined maximum current value.

4. The image forming apparatus according to claim 1, wherein the plurality of recording materials include a first recording material and a second recording material which follows the first recording material, wherein the plurality of heating elements include a first heating element that heats the image heating regions continuously for the first recording material and the second recording material, and a second heating element that heats the non-image heating region for the first recording material and heats the image heating region for the second recording material, and wherein the control portion controls the power to be supplied to the second heating element at the second maximum energizing duty when the image of the second recording material is fixed.

5. The image forming apparatus according to claim 4, wherein the second maximum energizing duty is acquired based on: the first maximum energizing duty; an allowable current value that is suppliable to the fixing portion in the image forming apparatus; a predetermined fixed duty; an effective value of a current value detected by the current detecting unit when the heating elements are energized at the fixed duty; and a current value of the second heating element detected by the current detecting portion.

6. The image forming apparatus according to claim 1, wherein the fixing portion includes:

a heater unit including a heater having the plurality of heating elements, and a substrate on which the plurality of heating elements are disposed; and a cylindrical film of which inner surface is contacted by the heater unit, wherein the fixing portion forms a nip portion in which the film is held between the heater and a pressure roller.

7. An image forming apparatus comprising:

an image forming portion configured to form an image on a recording material;

a fixing portion configured to heat the image and fix the image on the recording material, and including a plurality of heating elements arranged in a direction perpendicular to a conveying direction of the recording material;

a plurality of temperature detecting portions configured to individually detect temperatures of a plurality of heating regions which are heated by the plurality of heating elements respectively;

a control portion configured to individually control an energizing duty according to power supplied to the plurality of heating elements so that each of the temperatures detected by the plurality of temperature detecting portions maintain control target temperatures, the control portion setting a control target temperature of an image heating region, which is a region to heat an image portion where the image is formed in the recording material, out of a plurality of heating regions, as a first control target temperature and a control target temperature of a non-image heating region, which is a region to heat a non-image portion where the image is not formed in the recording material, out of the plurality of heating regions, as a second control target temperature, which is lower than the first control target temperature; and a voltage detecting portion configured to detect input voltage that is inputted to the image forming portion and the fixing portion, wherein the control portion sets the energizing duty within a range of a maximum energizing duty, and in a continuous image formation in which the images are continuously formed and fixed on a plurality of recording materials from an initial state where the temperature detected by the temperature detecting portion becomes not higher than a predetermined temperature, when a period from start of the continuous image formation on a first recording material, out of the plurality of recording materials, to arrival of the first recording material at the fixing portion, is regarded as a first period, and a period from the arrival of the first recording material at the fixing portion to the end of the continuous image formation is regarded as a second period, a second maximum energizing duty that is set when the control portion supplies power to the plurality of heating elements in the second period is higher than a first maximum energizing duty that is set when the control portion supplies power to the plurality of heating elements in the first period, and the second maximum energizing duty is switched from the first maximum energizing duty in the middle of the second period.

8. The image forming apparatus according to claim 7, wherein the maximum energizing duty, which is set in the first period, is set based on a voltage value detected by the voltage detecting portion and an allowable current value that is suppliable to the fixing portion in the image forming apparatus.

9. The image forming apparatus according to claim 7, wherein the maximum energizing duty that is set in the second period is set so that a total current value, acquired based on a voltage value detected by the voltage detecting portion and a resistance value of each of the plurality of heating elements, does not exceed a predetermined maximum current value.

10. The image forming apparatus according to claim 7, wherein the plurality of recording materials include a first recording material and a second recording material which follows the first recording material, wherein the plurality of heating elements include a first heating element that heats the image heating regions continuously for the first recording material and the second recording material, and a second heating element that heats the non-image heating region for the first recording material and heats the image heating region for the second recording material, wherein the control portion controls the power to be supplied to the second heating element at the second maximum energizing duty when the image of the second recording material is fixed.

11. The image forming apparatus according to claim 10, wherein the second maximum energizing duty is acquired based on: the first maximum energizing duty; an allowable current value that is suppliable to the fixing portion in the image forming apparatus; a voltage value of a commercial power supply that is detected by the voltage detecting portion and is inputted to the image forming apparatus; and a resistance value of the second heating element.

* * * * *